US008186635B2

(12) United States Patent
DeVito

(10) Patent No.: US 8,186,635 B2
(45) Date of Patent: May 29, 2012

(54) SUPPORT HOOKS FOR USE WITH PEGBOARDS

(76) Inventor: John P. DeVito, Mount Prospect, IL (US)

( * ) Notice: Subject to any disclaimer, the term of this patent is extended or adjusted under 35 U.S.C. 154(b) by 273 days.

(21) Appl. No.: 12/616,876

(22) Filed: Nov. 12, 2009

(65) Prior Publication Data

US 2010/0116956 A1 May 13, 2010

Related U.S. Application Data

(60) Provisional application No. 61/199,077, filed on Nov. 13, 2008.

(51) Int. Cl.
*A47B 96/00* (2006.01)

(52) U.S. Cl. ..... 248/220.41; 248/220.21; 248/220.31

(58) Field of Classification Search ..... 248/220.41, 248/220.21, 220.31; 211/59.1, 90.01
See application file for complete search history.

(56) References Cited

U.S. PATENT DOCUMENTS

| | | | | |
|---|---|---|---|---|
| 3,012,745 | A * | 12/1961 | Donovan | 248/71 |
| 4,147,789 | A * | 4/1979 | Stutz et al. | 514/221 |
| 6,402,106 | B1 * | 6/2002 | Padiak | 248/221.11 |
| 6,702,128 | B2 * | 3/2004 | Winig et al. | 211/90.01 |
| 7,353,957 | B2 * | 4/2008 | Winig et al. | 211/59.1 |

* cited by examiner

*Primary Examiner* — Amy J Sterling
(74) *Attorney, Agent, or Firm* — Wood, Phillips, Katz, Clark & Mortimer

(57) ABSTRACT

A support for mounting so as to project from the front face of a panel having an array of holes therethrough. The support includes a support body having a distal end spaced from the panel when the support is mounted thereon, with a pair of legs extending from the proximal end of the support body. The legs each have an ear spaced from the support body proximal end to define a shoulder facing the rear face of the panel when the support is mounted thereon. Support flanges on the support body proximal end define mounting surfaces facing the shoulders defined on the leg ears, and a biasing flange on the support body proximal end includes a flexible portion projecting beyond the support flange mounting surfaces toward the shoulders defined on the leg ears.

5 Claims, 4 Drawing Sheets

SUPPORT HOOKS FOR USE WITH PEGBOARDS

CROSS REFERENCE TO RELATED APPLICATION(S)

Priority is claimed in Provisional Application No. 61/199,077, filed Nov. 13, 2008 and entitled "Flex-Peg Panel Hanger".

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to display supports, and more particularly to support hangers mountable to pegboards.

BACKGROUND OF THE INVENTION AND TECHNICAL PROBLEMS POSED BY THE PRIOR ART

Support or display panels having holes therein (such as pegboards) are used in a variety of applications in order to display (e.g., at a point of sale) and/or organize (e.g., in a residential garage) products and materials. Such pegboards commonly consist of panels with an array of holes therethrough, with the holes typically being in a grid arrangement with regular spacing therebetween (e.g., with 1 inch centerline spacings).

A variety of support hooks and the like can be mounted to the pegboard to support a wide variety of products at virtually any position on the pegboard. One type of support hook commonly used with such pegboards include legs which are pushed through the holes in the pegboard, with ears on the end of the legs defining shoulders which will engage the back of the pegboard when pushed through the holes to retain the legs in the holes and thereby prevent the support hooks from pulling off of the pegboard. The hooks also include a face portion which will engage the front of the pegboard, with the spacing between the face portion and the ear-defined shoulders substantially matching the thickness of the pegboard.

Even among pegboards which may be considered to be "standard", they can be made of different materials and their dimensions can vary widely. For example, even material which is considered "hardboard or equivalent" with a nominal thickness of 0.250 inches will have tolerances of −0.010 and +0.005, meaning the thickness of those materials may be between 0.240 and 0.255 inches. Moreover, since many manufacturers operate on the metric system, even "equivalent" material thicknesses could be different (e.g., 6 mm thicknesses are nominally 0.225 inches, making the boards 0.215 to 0.230 inches thick). In short, variations in the expected nominal thickness of the panels being used could be from 0.210 to 0.230 and 0.240 to 0.255 inches.

Moreover, not only are the panel thickness variable, but the presence or lack of decoration on such panels can affect the thickness (e.g., 0.002 inch for a liquid coating [paint], 0.010 inch for a printed graphic glued to the panel surface, and 0.020 inch for a melamine laminate [rigid protective surface]). In short, a wide variety of effective panel thicknesses can be expected to be encountered.

[Note that material ranges listed herein are based on reviews of various manufacturers' published product specifications and field research of material already in use at retail locations, and may not represent any specific material from a specific supplier.]

Still further, the holes punched through the pegboards can vary as well, as there is not clear industry standard in this regard. Thus, varying hole sizes are frequently provided, depending on a variety of factors in the manufacture of the pegboard, including the country of manufacture, manufacturer offerings, existing equipment (tooling is very expensive and not readily changed if not required), age of the manufactured unit, and retailer specifications. Thus, it is not unusual to find pegboards having holes having different diameter holes, ranging from 0.250 to 0.280 inches. Therefore, even with pegboards in which the hole centers have a standard spacing, the variance of the spacing between the outer edges of adjacent holes (typically support hooks are secured in two adjacent holes) can be 0.030 inches (based on the closest spacing being with holes having 0.125 inch radius versus the largest spacing having 0.140 inches radius).

As a result of these variations in the dimensions of holes and panel thicknesses, support hooks which are manufactured to work with one size will not work as well with other sizes.

For example, support hooks having a spacing between their face portion and their ear-defined shoulders of 0.255 inches will ensure that when mounted the ear-defined shoulder will reach the back side of the pegboard, but when used with a pegboard having a thickness of only 0.210 inches there will be a looseness resulting in the legs of the support hooks being movable in and out of the holes by up to 0.045 inches. Not only will such looseness cause the hooks to feel that they are insecurely mounted, it can also result in the hooks to extend from the pegboard at a downwardly sloped angle rather than fully horizontally. In retail displays, for example, this can result in an undesirable and sloppy appearance. Moreover, such looseness allowing movement of the legs can increase the risk that the hooks will unexpectedly work their way loose of the pegboard and thereby potentially allow whatever is being supported to be damaged by falling to the ground.

As another example, if some middle ground of sizes were used for the support hooks in an effort to accommodate different pegboard dimensions (e.g., a 0.240 inches spacing between the hook face portion and ear-defined shoulder), there would still be some undesirable motion allowed with the smaller thickness pegboards (e.g., 0.030 inches for 0.210 inches). Moreover, with the larger thickness pegboards (e.g., 0.255 inches) the ears on the legs may not even get behind the rear of the pegboard and the hook could precariously appear to be mounted when in fact its legs only fit loosely in the pegboard and could easily pull out whenever a weight is attempted to be hung on the hook. (Further, even if legs having 0.240 inches spacing were able to be sufficiently pressed into the pegboard to get the ears behind the rear of the pegboard, in such mountings the support would tend to tilt up from the pegboard rather than extending horizontally as preferred.)

Moreover, while different support hooks can be made specifically to accommodate each of the different hole sizes, and each of the different pegboard thicknesses, the costs associated with having to manufacture each size (including multiple molds for multiple sizes) can be significantly higher than the costs of molding one size, as can the costs of increased inventory size requirements, handling, etc. Further, since the end user of a pegboard may have a difficult time determining or remembering these dimensions (e.g., when the pegboard is hung on a wall, it can be difficult to measure its thickness), it can be similarly difficult for a user to determine which particular dimension support hooks to use with a particular pegboard. Thus, obtaining additional support hooks having the correct dimension for particular pegboard, or just determining which support hooks from an inventory of such hooks to use with a particular pegboard, can all be problematic and subject to errors. Moreover, even if incorrectly sized supports are able to be mounted to a particular pegboard, use with thicker panels will cause the hook to display at a more acute angle (point toward the ceiling), whereas use with thinner panels can cause the hook to display at a more obtuse angle (point toward the floor).

Additionally, some types of pegboard hooks which have been used heretofore are installed from a levered position (i.e., by rotating the hook upward, feeding prongs into a set of holes, and then reversing the rotation to position the hook against the pegboard with the prongs trapped behind the pegboard). While those hooks can provide adequate support, the manner in which they must be mounted requires free space above the mounting position, and thus mounting these hooks at the top of the pegboard can be difficult if not impossible in many installations, for example pegboards having an overhanging top plate, such as a header graphic in a retail display.

The present invention is directed toward overcoming one or more of the problems set forth above.

SUMMARY OF THE INVENTION

In one aspect of the present invention, a support is provided for mounting so as to project from the front face of a panel having an array of holes therethrough. The support includes a support body having a distal end spaced from the panel when the support is mounted thereon, with a pair of legs extending from the proximal end of the support body. The legs each have an ear spaced from the support body proximal end to define a shoulder facing the rear face of the panel when the support is mounted thereon. Support flanges on the support body proximal end define mounting surfaces facing the shoulders defined on the leg ears, and a biasing flange on the support body proximal end includes a flexible portion projecting beyond the support flange mounting surfaces toward the shoulders defined on the leg ears.

In one form of this aspect of the present invention, the biasing flange extends in one of an up or down direction from the support body when the support is mounted on a panel, and the support flanges have portions extending above and below the support body with the portion extending from the support body in the other of the up or down direction curved toward the shoulders defined on the leg ears.

In another form of this aspect of the present invention, flexible biasing wings extend laterally from the support flanges, the wings being curved laterally whereby the wing ends spaced from the support flanges project beyond the support flange mounting surfaces toward the shoulders defined on the leg ears. In a further form, the thickness of each biasing wing is tapered to reduce as the spacing from the associated support flange increases. In another further form, the biasing flange extends in one of an up or down direction from the support body when the support is mounted on a panel, and the support flanges have portions extending above and below the support body with the portion extending from the support body in the other of the up or down direction curved toward the shoulders defined on the leg ears. In a still further form, the biasing flange extends downwardly from the support body with its flexible portion engaging the panel front face when the support is mounted on the panel, and the shoulders defined on the ears extend both laterally from and above the legs.

In still another form of this aspect of the present invention, the legs are flexible with the ears spaced apart a distance greater than the spacing between the legs at the proximal end of the support body.

In yet another form of this aspect of the present invention, the support body includes at least one channel slit therein extending toward the distal end from the proximal end, the slit defining a flexible arm supporting one of the support flanges and one of the legs. In a further form, a limiter projects into the defining slit from the flexible arm adjacent the support body proximal end, with the limiter adapted to engage the support body on the other side of the defining slit when the leg ears are at a selected spacing from each other, wherein the flexible arm allows the proximal end of the support body to be squeezed together when mounting the support on the panel to align the leg ears with adjacent panel holes through which the legs extend when the support is mounted on the panel.

In another aspect of the present invention, a support is provided for mounting so as to project from the front face of a panel having an array of holes therethrough. The support includes a support body having a distal end spaced from the panel when the support is mounted thereon, and a pair of legs extending from the proximal end of the support body with the legs each having an ear spaced from the support body proximal end to define a shoulder facing the rear face of the panel when the support is mounted thereon. Support flanges are on the support body proximal end defining mounting surfaces facing the shoulders defined on the leg ears, and a biasing flange on the support body proximal end includes a flexible portion between the support flanges and projecting beyond the mounting surfaces toward the shoulders defined on the leg ears, and the biasing flange also extending downwardly from the support body when the support is mounted on the panel. Flexible biasing wings extend laterally from the support flanges and are each curved in the lateral direction toward the shoulders defined on the leg ears. The legs are flexible with the ears spaced apart a distance greater than the spacing between the legs at the proximal end of the support body. The support body has a channel slit therein extending toward the distal end from the proximal end, with the slit defining a flexible arm supporting one of the support flanges and one of the legs and allowing the proximal end of the support body to be squeezed together when mounting the support on the panel to align the leg ears with adjacent panel holes through which the legs extend when the support is mounted on the panel.

In one form of this aspect of the present invention, the biasing flange extends in one of an up or down direction from the support body when the support is mounted on a panel, and the support flanges have portions extending above and below the support body with the portion extending from the support body in the other of the up or down direction curved toward the shoulders defined on the leg ears. In a further form, the biasing flange extends downwardly from the support body with its flexible portion engaging the panel front face when the support is mounted on the panel, and the shoulders defined on the ears extend both laterally from and above the legs.

In another form of this aspect of the present invention, a limiter projects into the defining slit from the flexible arm adjacent the support body proximal end, with the limiter being adapted to engage the support body on the other side of the defining slit when the leg ears are at a selected spacing from each other.

In yet another aspect of the present invention, a display system is provided including a panel having an array of evenly spaced holes therethrough, and a plurality of supports selectively mounted to the front face of the panel to selectively support display items. The supports each include a support body having a distal end spaced from the panel, and a pair of legs extending from the proximal end of the support body and through holes in the panel with the legs each having an ear spaced from the support body proximal end to define a shoulder facing the rear face of the panel. Support flanges on the support body proximal end define mounting surfaces facing the panel front fact, and a biasing flange on the support body proximal end including a flexible portion projecting beyond the support flange mounting surfaces toward the shoulders defined on the leg ears. The biasing flange flexible portion engages the front face of the panel to draw the ear shoulders into engagement with the rear face of the panel.

In one form of this aspect of the present invention, flexible biasing wings extend laterally from the support flanges, with the wings being curved laterally whereby the wing ends spaced from the support flanges engage the panel. In a further form, the thickness of each biasing wing is tapered to reduce as the spacing from the associated support flange increases. In a still further form, the biasing flange extends down from each support body and the support flanges have portions extending above and below the support body, with the portions extending above the support body being curved toward the panel whereby the upper end of the portions engage the panel. In yet a further form, each support, in a longitudinal direction extending from the distal end to the ears, is spaced (1) between (a) the support flange mounting surfaces below the support body and (b) the shoulders defined by the leg ears a distance X, (2) between (a) the biasing flange flexible portion and (b) the shoulders defined by the leg ears a distance $Y_1$, (3) between (a) the support flange mounting surfaces above the support body and (b) the shoulders defined by the leg ears a distance $Y_2$, and between (a) the wing ends and (b) the shoulders defined by the leg ears a distance $Y_3$, wherein the panel may have thicknesses ranging from X to about Y, where $Y<X$ and Y is the smallest of $Y_1$, $Y_2$, and $Y_3$.

In another form of the present invention, the support bodies each have at least one channel slit therein extending toward the distal end from the proximal end, with the slit defining a flexible arm supporting one of the support flanges and one of the legs. In a further form, limiters project into the defining slits from the flexible arms adjacent the support body proximal ends, with the limiters each being adapted to engage the support body on the other side of the defining slit when the leg ears are at a selected spacing from each other, and the flexible arm allowing the proximal end of each of the support bodies to be squeezed together when mounting the support on the panel to align the leg ears with adjacent panel holes through which the legs extend when the support is mounted on the panel.

DETAILED DESCRIPTION OF THE INVENTION

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus operating in accordance with this invention is described in the normal operating position (with the panel oriented vertically with supports extending horizontally from the panel), and terms such as upper, lower, horizontal, etc., are used with reference to this position.

Except as otherwise detailed, the supports of this invention can have certain conventional configurations the details of which, although not fully illustrated or described, will be apparent to those having skill in the art and an understanding of the necessary functions of such components and mechanisms.

Further, some of the Figures illustrating the preferred embodiment of the present invention show conventional structural details and mechanical elements or components that will be recognized by one skilled in the art. Detailed descriptions of such elements are not necessary to an understanding of the invention, and accordingly, are herein presented only to the degree necessary to facilitate an understanding of the novel features of the present invention.

A support 20 according to the present invention is shown in FIGS. 1-5 and 8, and shown as mounted to a suitable display/organizing panel, such as a pegboard 22, in FIGS. 6-7 and 9-10.

Figure 6:
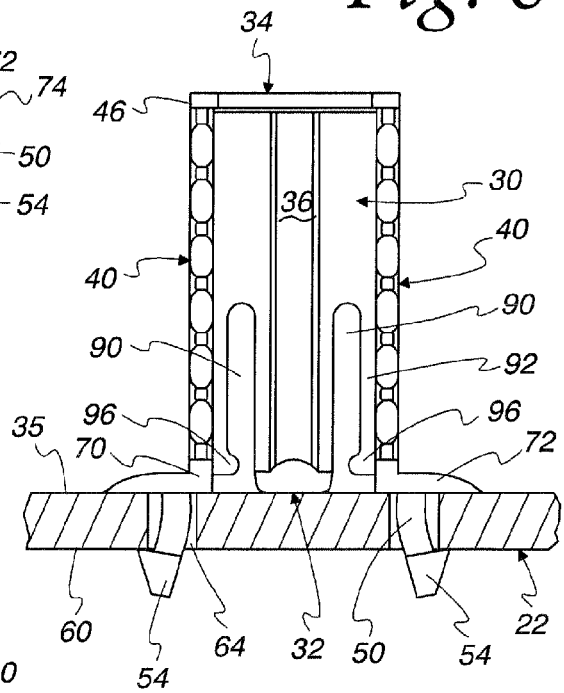
FIG. 6 is a top view of the support of FIG. 1 as mounted to a panel (shown in cross-section) of a display system.
Figure 7:
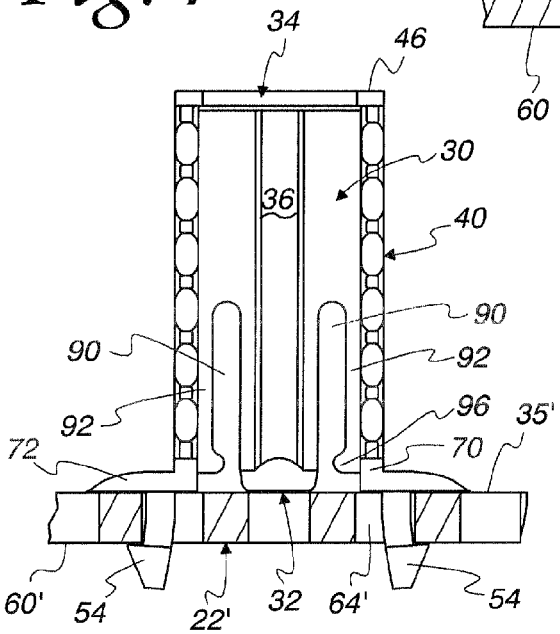
FIG. 7 is a top view of the support of FIG. 1 as mounted to a display system having a panel (shown in cross-section) different from that illustrated in FIG. 6.
Figure 8:
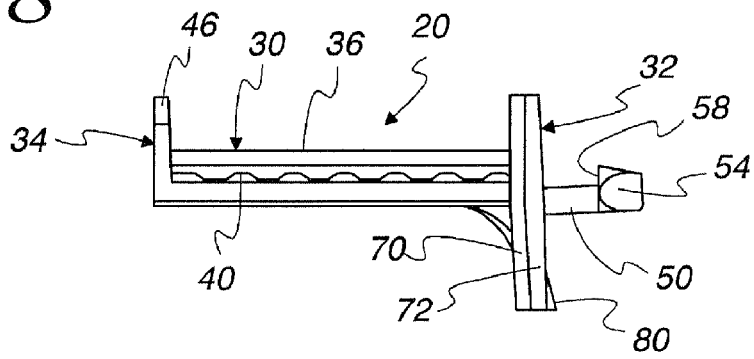
FIG. 8 is a right side view of the support of FIG. 1.
Figure 9:
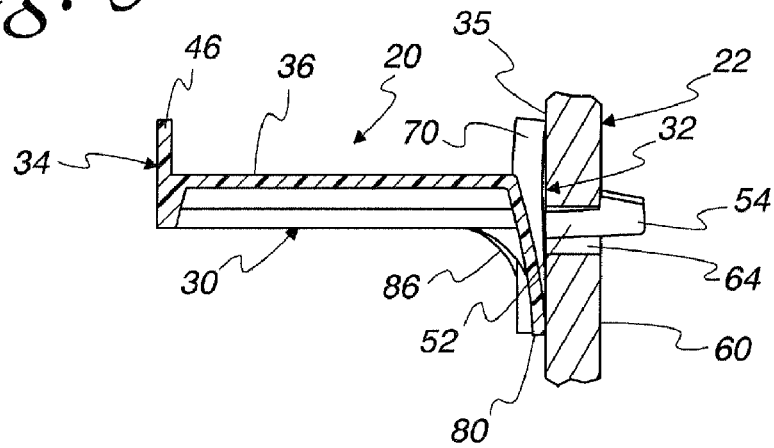
FIG. 9 is a right side view of the support and panel of FIG. 6.
Figure 10:
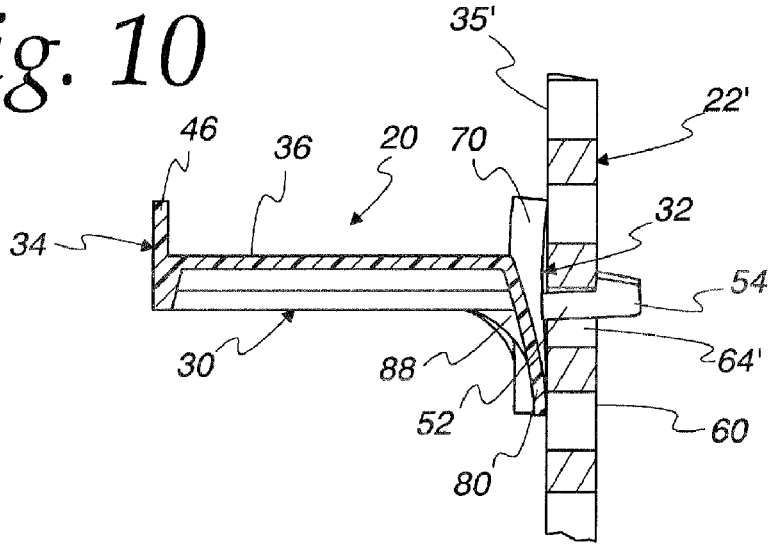
FIG. 10 is a right side view of the support and panel of FIG. 7.

In the illustrated embodiment, the support 20 consists of a support body 30 which, when mounted to a pegboard 22, extends generally horizontally from a proximal end 32 adjacent the pegboard 22 to a distal end 34 spaced from the front face 35 of the pegboard 22. FIGS. 6 and 9 illustrate one pegboard 22 design, and FIGS. 7 and 10 illustrate a different pegboard or panel 22' (with common elements having prime ["'"] added to their reference numerals to distinguish between similar but different aspect).

A raised rib 36 may advantageously extend between the proximal and distal ends 32, 34 to strengthen the body 30 against bending when weight is supported thereon.

Side rails 40 having aligned indentations 42 may also be advantageously included. Such indentations may, for example, help to evenly space product cards hung from the body 30 for consumer shopping convenience (it being easier to remove only the desired one or two cards if they are spaced apart as hung).

A front stopper 46 may also be advantageously provided on the distal end 34 of the support body 30 to assist in retaining items supported on the body 30 from being accidentally removed. For example, if product cards are supported on the body 30, removal of the cards by a consumer will require a specific "lifting" action to remove the carded product from the display for purchase. Further, the stopper 46 will prevent cards from falling off the body 30 unintentionally or accidentally (e.g., if the display is moved for relocation, or gets jarred when a customer bumps into it).

A pair of prong-type legs 50 extend from the proximal end of the support body 30, with the legs 50 each having an ear 54 spaced from said support body proximal end 32 to define a shoulder 58 facing the rear face 60 (see FIGS. 6-7 and 9-10) of the pegboard 22 when the support 20 is mounted thereon. The ends of the legs 50 may be pointed to facilitate aligning the arms 50 with panel holes 64 when mounting.

The ear shoulders 58 may advantageously extend out both laterally from the sides of the legs 50 and vertically up from the legs 50, whereby they may engage not only the lateral sides of the rear face 60 of the panel 22 adjacent the holes 64 (see FIGS. 6-7 and 9-10) but also will tend to engage the rear panel face 60 above the holes 64 (such engagement assisting in counteracting the downward twisting force applied by weight supported on the support body 30.

Support flanges 70 extend above and below the legs 50 on opposite sides of the support body proximal end 32, with wings 72 projecting laterally outwardly to an outer end or edge 74 spaced from each of the support flanges 70. The rear face 76 of each support flange 70 and associated wing 72 is oriented substantially vertically at the proximal end 32, and generally faces rearwardly toward the leg ears 54.

Figure 1:
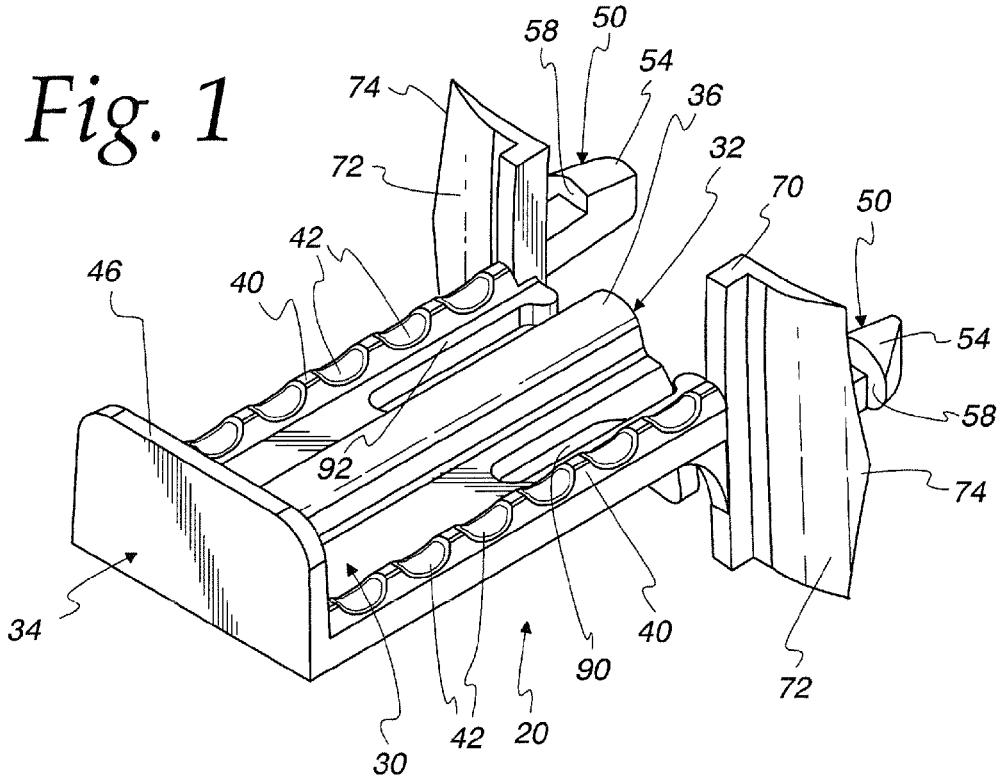
FIG. 1 is a front isometric view, from above and to the right, of a support incorporating the present invention.
Figure 2:
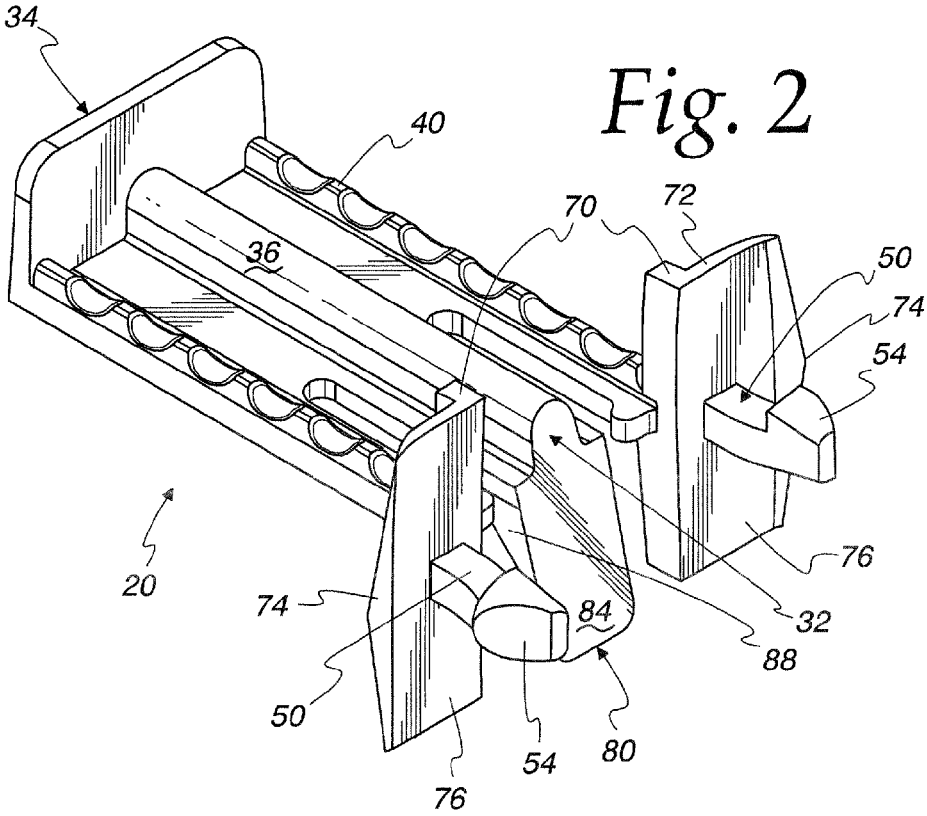
FIG. 2 is a rear isometric view, from above and to the left, of the support of FIG. 1.
Figure 3:
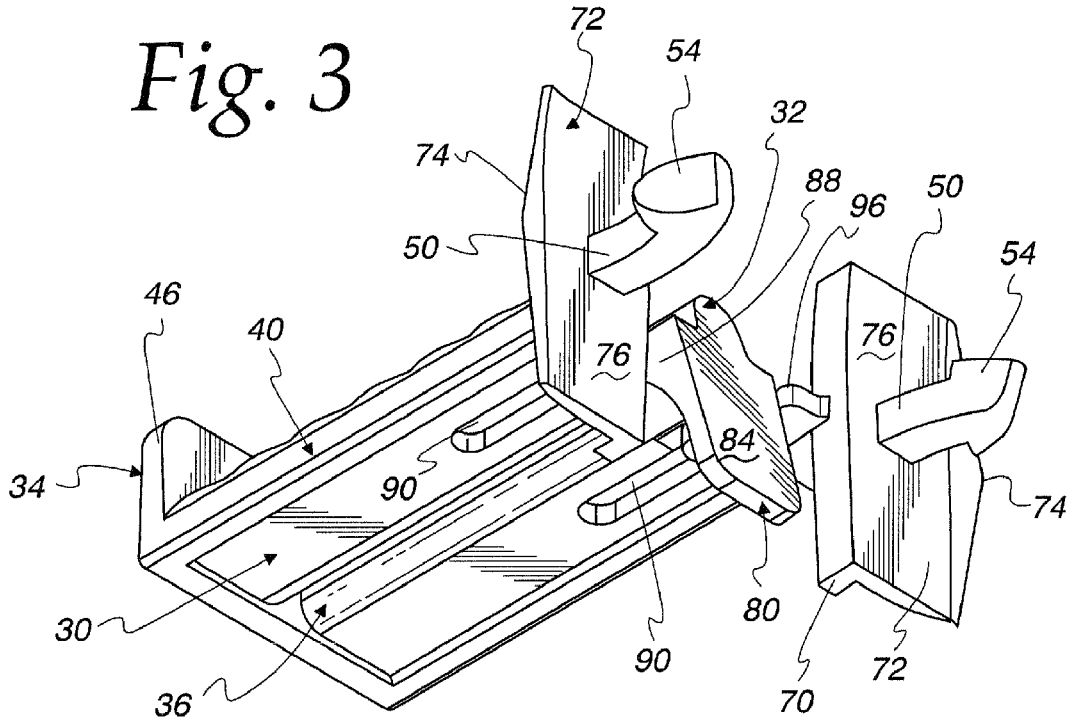
FIG. 3 is a rear isometric view, from below and to the left, of the support of FIG. 1.
Figure 4:
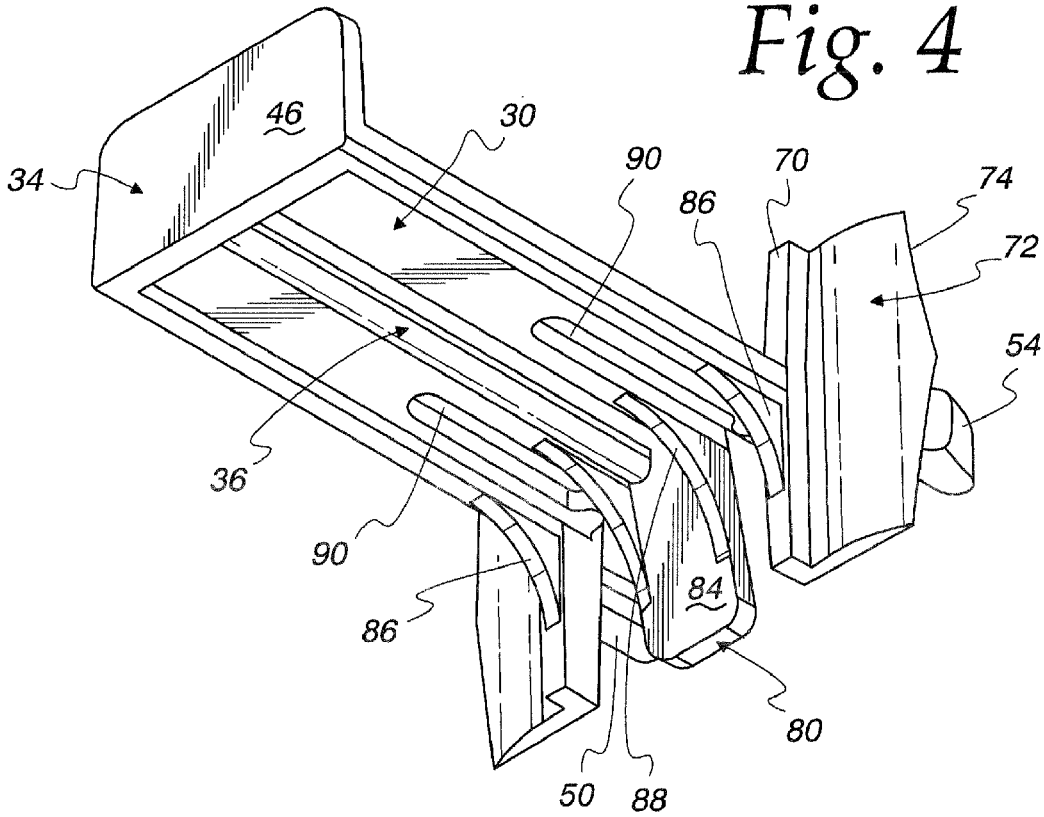
FIG. 4 is a front isometric view, from below and to the right, of the support of FIG. 1.
Figure 5:
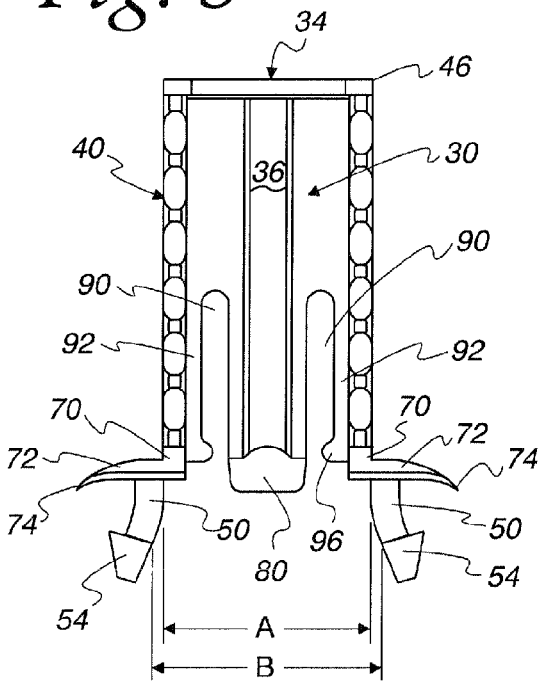
FIG. 5 is a top view of the support of FIG. 1.

In the lateral direction (i.e., horizontally from the support flange 70 to the wing outer edge 74), each wing 72 is advantageously curved toward the leg ears 54, with each wing 72 also having a variable, decreasing thickness in the lateral direction (see, e.g., FIG. 5). Further, the upper portion of each support flange 70 and associated wing 72 (i.e., the portion above the legs 50) may be advantageously curved in a vertical direction also toward the leg ears 54. As a result, the laterally outer edges 74 of the wings 72 and the upper edge of each associated support flange 70 and wing 72 extend furthest back in the direction of the leg ears 54.

As a result of the above curvatures of the support flanges 70 and wings 72, when a support 20 is mounted horizontally on a pegboard 22, the tops of the flanges 70 and wings 72, and the outer edges 74 of the wings 72, may first engage the front face 35 of the panel 22 with the elastic flexibility of the support flanges 70 and wings 72 able to advantageously provide a biasing force assisting in keeping the support 20 properly mounted thereon (i.e., by pulling the ears 54 forward against the rear face 60 of the panel 22 so that the ear shoulders 58 engage the rear face 60).

It should also be appreciated that the curvature of the support flanges 70 and wings 72 assist in properly positioning the leg ears 54 for mounting.

That is, when a support 20 is pushed into a panel 22 with its legs 50 extending through the panel holes 64, when the wing outer edges 74 engage the panel front face 35 and then the support 20 is pushed further, the wings 72 will be biased toward pivoting back around a vertical axis (i.e., clockwise for the left wing 72 and counterclockwise for the right wing 72 in FIGS. 5-7). Such biasing force will also be applied to the legs 50, thereby advantageously biasing the legs 50 outwardly toward the desired mounting position in which the laterally extending portion of their ear surfaces 58 are behind the sides of the panel holes 64.

The curvature in the vertical direction of the upper portion of the support flanges 70 functions similarly. That is, when the upper end of the support flanges 70 engages the panel front face 35 during mounting, further pushing in of the support 20 will apply a biasing force toward pivoting the support flanges 70 back (i.e., counterclockwise in FIGS. 8-10), such force carried through to the legs 50 biasing them up toward the desired mounting position in which the vertically extending portion of their ear surfaces 58 are behind the tops of the panel holes 64.

A biasing flange 80 is also included centrally on the support body proximal end 32 between the support flanges 70, and extending downwardly in the normal mounting position. The biasing flange 80 includes a flexible portion 84 projecting beyond the rear face 76 of the support flanges 70 so that it too will provide an advantageous biasing force ensuring that the leg ears 50 will be drawn into engagement with the rear face 60 of the panel 22 with portions (e.g., the support flanges 70, wings 72 and biasing flange 80) also engaging the panel front face 35 when mounted on a variety of thicknesses of panels 22. In addition to the fact that the downwardly projecting flange 80 also tends to lift the support body 30 up (counteracting the weight of the support, and whatever may be supported thereon), such consistent biasing force also helps to ensure that the support extends out substantially perpendicular to the panel 22 as is most advantageous for aesthetic reasons as well as for reliable supporting (i.e., supports which sag down look cheap and can more easily pull loose of the panel when weight is supported on them).

Further, it should be appreciated that the distance Y between the ear shoulders 58 and the mounting surfaces 72 may itself be variable given the outward curve of the legs 50 (i.e., the ears 54 are spaced apart a distance greater than the spacing between the legs 50 at the proximal end 32 of the support body 30, or B>A in FIG. 5) and their elastic flexibility. For example, when the legs 50 are straightened out, the distance Y may be greater than when the legs 50 are curved. It should be appreciated that the flexibility of the legs 50 may be advantageously designed whereby the distance Y when the legs 50 are straightened is the maximum thickness of the pegboard 22 to which the support 20 is anticipated to be mounted, with the legs 50 thereby facilitating secure mounting by biasing the ear shoulders 58 against the rear face 60 of the pegboard 22 for any panel thickness (up to the maximum thickness) in which the legs 50 are not in their relaxed curved condition (see, e.g., FIG. 5).

Reinforcing ribs or gussets 86, 88 (see particularly FIG. 4) may be provided between the bottom of the support body 30 and the support and biasing flanges 70, 80, to both strengthen the support body 30 against being undesirably bent down as well as to enhance the strength of the biasing force of the flanges 70, 80.

It should be appreciated that the mentioned curvature in the vertical direction (i.e., the curvature extending from generally the mid-point of the support flange 70 [adjacent the leg 50] to the top edge of the flange 70) could also be provided by a natural tipping of the support 20 during mounting. For example, with the biasing flange 80 flexible but reasonably stiff against bending (due, e.g., to the gussets 88), when the biasing flange 80 first engages the front face 35 of the panel 22 as the support 20 is first pushed into the panel 22, the support 20 will naturally tend to tip forward (i.e., rotate clockwise in FIGS. 8-10) until the upper edge at the top of the support flanges 70 also engage the front face 35 of the panel 22 (with the curvature in effect being provided by the combined orientation of the rear faces of the biasing flange 80 and the support flanges 70). This can best be seen in FIG. 8 where the proximal end 32 can be seen to effectively be curved rearwardly from the bottom (where the biasing flange 80 projects outwardly) to the top (where the support flanges 70 define the rear face) when the support body 30 is tipped up as mentioned. Further, it should be appreciated that a reinforcing rib (not shown) could be provided on the rear face of the upper portion of the support flanges 70 to still further provide an effective rearward curvature allowing the top edge of the support flanges 70 to advantageously (as previously described) press against the panel 22 during mounting. Given the lack of a panel front face 35 around the legs 50 during initial mounting, because of the larger holes 64, such a rib could even be tapered to a slightly narrower top end (to facilitate removal from a mold, for example) while still providing an effectively rearward curvature to the upper portion of the support flanges 70 to provide the described advantage (i.e., assisting in biasing rear ends of the legs 50 up during mounting to reliably locate their ears 54 behind the panel rear face 60).

The support body 30 also may advantageously have a pair of channel slits 90 therein extending toward the distal end 34 from the proximal end 32, the slits 90 defining a pair of flexible arms 94, each of which support one of the support flanges 70 and one of the legs 50. Further, a limiter 96 adjacent the support body proximal end 32 may advantageously project into the defining slit 90 from at least one of the flexible arms 92. The limiter 96 is adapted to engage the support body 30 on the other side of the defining slit 90 when the leg ears 54 are at a selected spacing from each other when the proximal end 34 of the support body 30 is squeezed laterally together by a person mounting the support 20 on the panel 22. (The limiter 96 may also prevent the arm from being compressed too far and thereby potentially damaged or even broken off).

At the selected spacing provided by the limiters 96, the leg ears 54 may be aligned with adjacent panel holes 64 through which the legs 50 extend when the support 20 is mounted on the panel 20, and after the legs 50 are pushed through the holes 60, releasing the arms 94 will allow the arms 94 and attached legs 50 to flex outwardly so that the ear shoulders 58 are located behind, and biased against, the rear face 60 of the panel 22. When releasing the arms, the support 20 may also be advantageously twisted (generally around rib 36) to help to ensure that the ears 54 are positioned behind the rear face 60 of the panel 22 as desired for proper mounting.

It should be appreciated that a single slit 90 and associated limiter 96 providing the same function when mounting could also be advantageously provided within the scope of the present invention. A single slit 90 may not also reduce the chance of an arm 94 being damaged, but also may facilitate mounting of the support 20 by allowing the pointed end on one leg 50 (which is not associated with the slit 90) to be aligned in one panel hole 64, and then the one arm 94 may be simply squeezed inwardly to the extent necessary to align its leg 50 with the other hole 64, at which point the support 20 may be pushed fully into the panel 22 for mounting thereon (after which the user may release the support 20 and the legs 50 and flanges 70, 80 will be biased to engage the panel 22 as previously described.

To remove the support 20 from a panel 22, a user may squeeze its sides together (e.g., the arms 94) and rotate slightly to simply and easily disengage the ears 54 from the rear face 60 of the panel 22, allowing the support 20 to be easily pulled away from the panel 22.

It should be appreciated that the ability to mount and remove the supports 20 as described will, as opposed to certain prior art hooks, allow the uppermost row of holes 64 on a panel 22 to be reliably used. For example, merchandise can be displayed at the upper most row of available holes even if the display is topped with a overhanging top plate, such as a header graphic, without that graphic interfering with the ability of a merchandise seller to install the support 20 in such holes.

It should also be appreciated that supports 20 incorporating one or more features of the present invention may be readily used with panels 22 having a range of thicknesses, as well as with panels 22 in which the diameters and/or spacing of the holes 64 therethrough vary as well. As previously noted, such variations are common, and are likely to continue to exist, for a variety of reasons. Moreover, as also previously noted, the presence or lack of decoration on such panels can also result in variable thicknesses being encountered even when the basic panel material has a uniform thickness. Use of supports 20 embodying some or all of the features of the invention described herein not only avoids mistakenly using the wrong size support for a particular panel (which might have a range of thicknesses), but also allows a user to maintain a minimum inventory of supports 20 without the need to maintain different sets of supports for different panels 22. Further, such supports 20 will reliably support a variety of objects on such panels 22, whether display items or personal organized items, and whether the objects are to be held by hooks, hangers or containments specifically designed to function as needed, with the tension provided by the legs 50 and flanges 70, 80 helping to avoid accidental removal by bumping or panel movement.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A display system, comprising:

a panel having an array of evenly spaced holes therethrough;

a plurality of supports selectively mounted to the front face of the panel to selectively support display items, said supports each including a support body having a distal end spaced from the panel and a proximal end adjacent the panel, a pair of legs extending from the proximal end of the support body and through holes in the panel, said legs each having an ear spaced from said support body proximal end to define a shoulder facing the rear face of the panel, support flanges on said support body proximal end defining mounting surfaces facing said panel front face, a biasing flange on said support body proximal end including a flexible portion projecting beyond said support flange mounting surfaces toward said shoulders defined on said leg ears, and flexible biasing wings extending laterally from said support flanges, said wings being curved laterally whereby the wing ends spaced from said support flanges engage said panel the thickness of each biasing wing being tapered to reduce as the spacing from the associated support flange increases;

whereby said biasing flange flexible portion engages the front face of said panel to draw said ear shoulders into engagement with the rear face of said panel.

2. A display system, comprising:

a panel having an array of evenly spaced holes therethrough;

a plurality of supports selectively mounted to the front face of the panel to selectively support display items, said supports each including a support body having a distal end spaced from the panel and a proximal end adjacent the panel, a pair of legs extending from the proximal end of the support body and through holes in the panel, said legs each having an ear spaced from said support body proximal end to define a shoulder facing the rear face of the panel, support flanges on said support body proximal end defining mounting surfaces facing said panel front face, a biasing flange on said support body proximal end including a flexible portion projecting beyond said support flange mounting surfaces toward said shoulders defined on said leg ears, wherein said biasing flange extends down from the support body and the support flanges have portions extending above and below said support body, and the portions extending above the support body are curved toward the panel whereby the upper end of said portions engage said panel, and flexible biasing wings extending laterally from said support flanges, said wings being curved laterally whereby the wing ends spaced from said support flanges engage said panel;

whereby said biasing flange flexible portion engages the front face of said panel to draw said ear shoulders into engagement with the rear face of said panel.

3. The display system of claim 2, wherein in a longitudinal direction extending from the distal end to the ears, for each support:

the spacing between (a) the support flange mounting surfaces below said support body and (b) the shoulders defined by the leg ears is X;

the spacing between (a) the biasing flange flexible portion and (b) the shoulders defined by the leg ears is $Y_1$;

the spacing between (a) the support flange mounting surfaces above said support body and (b) the shoulders defined by the leg ears is $Y_2$;

the spacing between (a) the wing ends and (b) the shoulders defined by the leg ears is $Y_3$; and said panel may have thicknesses ranging from X to about Y, where $Y<X$ and Y is the smallest of $Y_1$, $Y_2$, and $Y_3$.

4. A display system, comprising:

a panel having an array of evenly spaced holes therethrough;

a plurality of supports selectively mounted to the front face of the panel to selectively support display items, said supports each including a support body having a distal end spaced from the panel and a proximal end adjacent the panel, a pair of legs extending from the proximal end of the support body and through holes in the panel, said legs each having an ear spaced from said support body proximal end to define a shoulder facing the rear face of the panel, support flanges on said support body proximal end defining mounting surfaces facing said panel front face, and a biasing flange on said support body proximal end including a flexible portion projecting beyond said support flange mounting surfaces toward said shoulders defined on said leg ears;

whereby said biasing flange flexible portion engages the front face of said panel to draw said ear shoulders into engagement with the rear face of said panel; and wherein said support bodies each have at least one channel slit therein extending toward said distal end from said proximal end, said slit defining a flexible arm supporting one of said support flanges and one of said legs.

5. The display system of claim 4, further comprising limiters projecting into said defining slits from said flexible arms adjacent the support body proximal ends, said limiters each being adapted to engage said support body on the other side of said defining slit when said leg ears are at a selected spacing from each other, wherein said flexible arm allows said proximal end of each of said support bodies to be squeezed together when mounting said support on said panel to align said leg ears with adjacent panel holes through which the legs extend when said support is mounted on the panel.

* * * * *